United States Patent [19]

Demuth et al.

[11] Patent Number: 4,979,272

[45] Date of Patent: Dec. 25, 1990

[54] METHOD FOR REPLENISHING FIBER BALES IN AN OPENING MACHINE

[75] Inventors: Robert Demuth, Nuerensdorf; Daniel Hanselmann, Winterthur; Max Tenger, Meyrin, all of Switzerland

[73] Assignee: Rieter Machine Works, Ltd., Winterthur, Switzerland

[21] Appl. No.: 333,463

[22] Filed: Apr. 5, 1989

[30] Foreign Application Priority Data

Apr. 19, 1988 [CH] Switzerland ..... 01430/88

[51] Int. Cl.[5] ..... D01G 7/00; D01G 7/08

[52] U.S. Cl. ..... 19/97.5; 19/80 R

[58] Field of Search ..... 19/80 R, 81, 97.5

[56] References Cited

U.S. PATENT DOCUMENTS 4,497,085 2/1985 Van Doorn ..... 19/80 R

FOREIGN PATENT DOCUMENTS 0633265 12/1961 Canada .
1150182 7/1983 Canada .
221306 5/1987 European Pat. Off. .
2301458 9/1976 France .
15261 8/1966 Japan .

*Primary Examiner*—Werner H. Schroeder
*Assistant Examiner*—Michael A. Neas
*Attorney, Agent, or Firm*—Kenyon & Kenyon

[57] ABSTRACT

The method provides for the replenishment of fiber bales to at least one row of fiber bales disposed on a spinning floor in operative positions extending along a path of a reciprocally mounted fiber bale opening machine. The bales are assembled in groups and delivered to a standby position on the spinning floor. When required, each fiber group is moved from the standby position into an operative position.

3 Claims, 5 Drawing Sheets

METHOD FOR REPLENISHING FIBER BALES IN AN OPENING MACHINE

This invention relates to a method for replenishing fiber bales in an opening machine. More particularly, this invention relates to a method for replenishing fiber bales to a row of fiber bales in a fiber bale opening machine.

Fiber bale opening machines are known, in practice, which reciprocate on a rail along a row of fiber bales and in so doing loosen fiber flocks from the surface of the row of bales by means of a rotating removal or extraction means and convey them on. A machine of this kind is sold throughout the world by Rieter Machine Works, Ltd., under the name of UNIFLOC. These machines are usually installed in sheds or the like which have a carefully levelled floor which usually has a predetermined surface quality.

Before being opened, however, and before being arranged in the operative rows, the bales must have the transportation packing removed in a bale opening shop. This packing usually comprises steel strapping to hold the bales together and sacking to protect the bales. The bales must also be externally cleaned by combing, this usually being carried out in another part of the building having a conventional floor quality and in which, depending upon the organization, the bales supplied may be stacked.

Also, the unpacked an pre-cleaned bales must be individually brought by fork-lift trucks from the bale opening shop to the room in which they can be arranged in the operative row of a fiber bale opening machine. However, one disadvantage of this procedure is that additional transportation equipment and associated staff are required. Another disadvantage is that this work has been performed only on five days of the week, whereas opening of the fiber bales should be carried out throughout the entire week, i.e. including the weekend. As a result, with the above mentioned transportation methods, very long travel times and large operating surfaces for the rows of bales and corresponding staff have been required to enable a machine of this kind to operate over the weekend and on a Monday morning until a new bale row has been put into the operative position.

Accordingly, it is an object of the invention to hold the areas of the operative rows of fiber bales in a fiber bale opening machine to a minimum necessary for mixing from different bale types at all times.

It is another object of the invention to replenish an operative row of fiber bales in a minimum of time and with a minimum of effort.

It is another object of the invention be able to replenish fiber bales to an operative row of fiber bales to be opened using a minimum of staff.

Briefly, the invention provides a method of replenishing fiber bales to a row of fiber bales extending along a path of a reciprocally mounted fiber bale opening machine. In accordance with the method, the fiber bales are brought in groups from a standby position into an operative position in the row of fiber bales. In this respect, the fiber bales are individually brought together to form a group of fiber bales at a location remote from the standby position and thereafter moved from that location to the standby position.

The invention also provides an apparatus for the replenishment of the fiber bales in an operative row which utilizes a truck for transporting at least one fiber bale. The truck is constructed with a displacement means for displacing the truck from place to place and locking means for locking the truck in place.

The displacement means on the truck includes at least two lockable castors disposed in a middle part of the truck and at least two non-lockable castors disposed at opposite ends of the truck.

The locking means locking the truck in place includes at least one lowerable support which is fixed to the truck. This support may be lowered when the truck has been positioned in a predetermined location so as to maintain the truck in that position.

The truck is also provided with at least one pivotally mounted support rod for retaining a fiber bale on the truck. In addition, a brake is disposed about the support rod to impose a braking force on the rod during pivoting thereof.

The basic advantage of the method as well as the truck is that fiber bale groups can be positioned in a standby position, that is, in a position outside the operative position of a row of fiber bales and can be moved into the operative position manually. That is, the fiber bale groups from the standby position can be moved by the staff present in a reduced number over a weekend. Also, sufficient bales can be available in the standby position without bales being supplied from a bale opening shop.

These and other objects and advantages of the invention will become more apparent from the following detailed description taken in conjunction with the accompanying drawings wherein:

FIG. 1 diagrammatically illustrates a plan view of a spinning mill floor in which two rows of fiber bales may be opened by a fiber opening machine and a floor on which fiber bales are stacked on one side and prepared for loading onto a truck in accordance with the invention;

Figure 1:
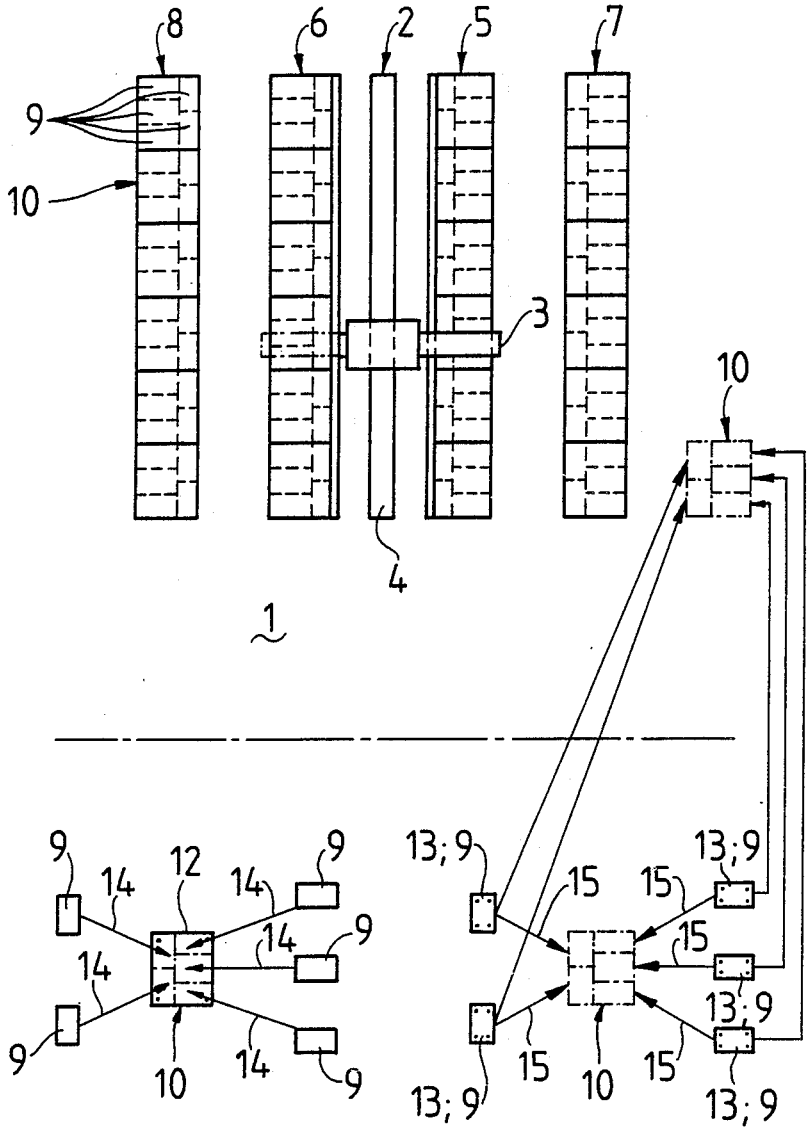

Referring to FIG. 1, the spinning floor 1 is provided with a fiber bale opening machine 2 which is of conventional construction. As indicated, the machine 2 includes a fiber removal means 3 and rails 4 between which a fiber feed passage (not shown) is provided. Machines of this kind are known and sold throughout the world by Rieter Machine Works, Ltd. under the name UNIFLOC. Accordingly, no further description is believed to be necessary.

As indicated, two operative rows 5, 6 of fiber bales are disposed in parallel along the path of the reciprocally mounted fiber bale opening machine 2. The operation of the machine 2 is such that the bale row 5 is opened first followed by the second bale row 6 or the rows 5, 6 may be opened in an alternating manner in order to remove a mixture of fibers simultaneously as is known.

As illustrated, two rows 7, 8 of fiber bales 9 formed into groups 10 are positioned in standby positions alongside the operative rows 5, 6. The bales 9 of each group 10 are movable from the standby position as a complete group into the operating position in order to replenish the rows 5, 6 from time to time.

The standby position of the individual groups 10 of bales 9 need not necessarily be in a row and parallel to the operative positions. Instead, since an entire group 10 may be moved manually, the group 10 may be disposed anywhere on the same floor in a standby position.

As illustrated, another part of the spinning mill floor 1, or a different floor, in a spinning works building provides space for storing individual fiber bales. In this respect, this section of the floor may be provided with suitable machines for the storage, unpacking and surface cleaning of the fiber bales so that the fiber bales may be combined into a group 10 on a truck 12 in a pattern as indicated by the arrows 14. After loading onto the truck 10, the loaded truck can be moved into a standby position on the spinning mill floor 1 via a suitable towing vehicle (not shown).

Alternatively, as indicated, each individual bale 9 may be loaded on a truck 13 sized to receive the bale. In this case, several trucks are then combined as indicated by the arrows 15 to form a group of trucks which can be brought as a unit by a towing vehicle (not shown) into a standby position on the spinning mill floor.

As a further variant, the individual trucks 13 each carrying a bale 9 may be moved individually into a standby position on the spinning mill floor 1 as shown diagrammatically by the elongated arrow. Such a variant would be desirable, for example, if the spinning mill floor on which the trucks are loaded is disposed immediately adjacent the spinning mill floor 1 such that this section of floor provides for the standby positions of the bale groups.

Figure 2:
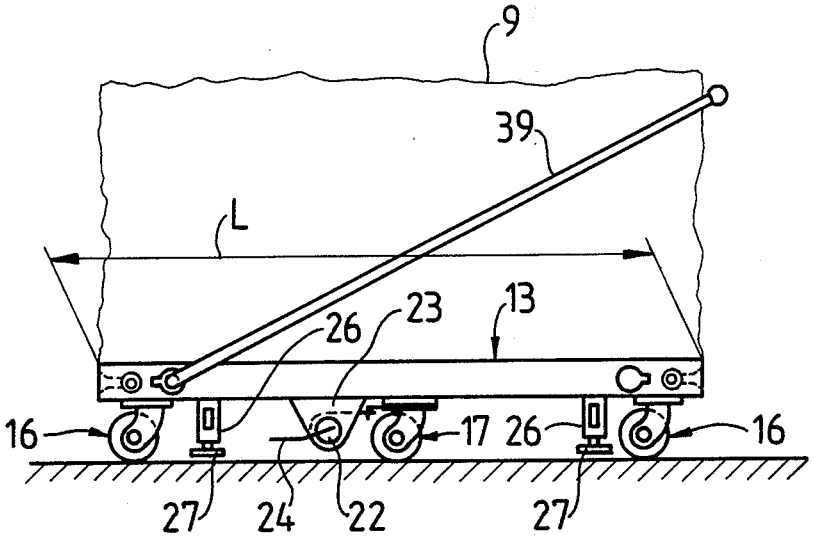
FIG. 2 illustrates a side elevational view of a fiber bale loaded truck constructed in accordance with the invention.
Figure 3:
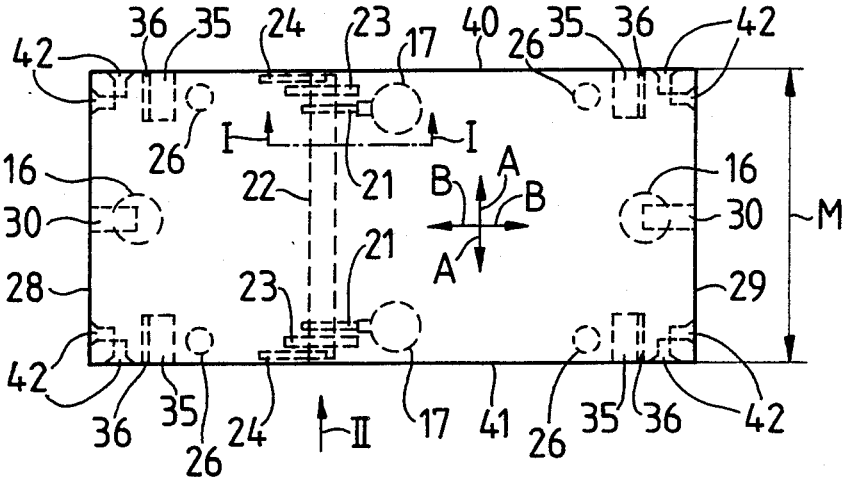
FIG. 3 illustrates a plan view of the truck of FIG. 2.

Referring to FIGS. 2 and 3, the truck 13 includes a horizontally disposed body sized to receive a fiber bale 9. In addition, the underside of the truck body is provided with displacement means for displacing the truck 13 from place to place. This displacement means includes a pair of non-lockable castors 16 pivotally mounted on an underside of the body at opposite ends of the truck 13 for rollably supporting the truck 13 on a floor and a pair of lockable castors 17 pivotally mounted on the underside of the body in a middle part of the truck for rollably supporting the body on the floor and directing the body in a direction of movement. The lockable castors 17 are disposed in the middle zone of the truck, i.e. the zone of the transverse axis so as to obtain optimum mobility.

The castors 16, 17 are of conventional structure and are sold, for example, under the trade name BLICKLE by Messrs. Heinrich Blikckle GmbH, Ittigen, Switzerland. However, the lockable castors 17 are modified as described below.

Figure 6:
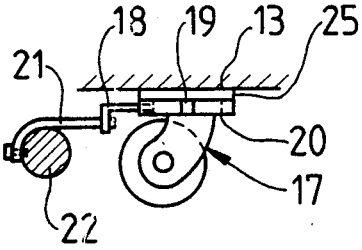
FIG. 6 illustrates a part cross sectional view of a locking means for a lockable castor in accordance with the invention.

Referring to FIG. 6, each lockable castor 17 is secured to the truck 13 via a stationary disc 25 and a rotary disc 20. In addition, the rotary disc 20 has a predetermined number of locking grooves 19, for example, four grooves which are in equi-spaced positions about a common axis so as to permit the castor 17 to be locked in one of four positions. The castor 17 is modified from the conventional castor by removal of a lever normally provided to remove a locking pin from a locking groove. Instead, a locking means is provided for simultaneously locking of both lockable castors 17 in a locked position. This locking means includes a rotatably mounted shaft 22 which extends across the truck body as indicated in FIG. 3. In addition, a pair of cables 21 are secured to and extend from the shaft 22 at opposite ends. Also, a pair of pins 18 are provided with each pin being secured to a respective cable 21 and being slidably mounted so as to selectively engage one of the locking grooves 19 of a rotary disk 20 (see FIG. 6). The locking pin 18 is biased into a locking groove 19 by a spring (not shown).

Figure 7:
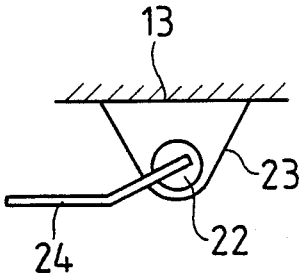
FIG. 7 illustrates a side view of a foot pedal for actuating the locking means for a lockable castor in accordance with the invention.

Referring to FIG. 3, the shaft 22 is rotatably mounted in a pair of bearings 23 near opposite ends. In addition, a foot pedal 24 (see FIG. 7) is connected at each end of the shaft 22 for rotating the shaft 22 in order to simultaneously lock and unlock the lockable castors 17. Thus, upon the application of foot pressure to either pedal 24, the shaft 22 rotates so that the locking pins 18 are withdrawn from the corresponding locking grooves 19 via the cables 21.

The locking grooves 19 in the rotary disc 20 of the respective lockable castors 17 are arranged so as to permit movement of the truck 13 in the perpendicular directions of travel indicated by the arrows A, B. When a castor 17 is unlocked, an impact against the truck 13 is sufficient to cause the castor 17 to rotate until the associated locking pin 18 again engages in a locking groove 19 offset by 90°.

The non-lockable castors 16 are constructed in similar fashion; however, the rotary disc thereof does not have any locking grooves and remains freely rotatable.

Referring to FIG. 2, the truck 13 is provided with a locking means for locking the truck 13 in place, for example, in an operative row 5, 6 (FIG. 1) or elsewhere in a standby position. As indicated, the truck is provided with at least two fixing means 26 which, in known manner, have a lowerable support or foot 27 which is able to rest on the spinning mill floor 1 (FIG. 1) with some pressure so that the truck 13 is no longer movable. Locking means of this type are known and have been used, for example for holding doors in a specific position. Usually, these locking means comprise a housing in which a piston connected to the foot 27 can be moved in opposition to a spring pressure and can be fixed by a clamping action. A further pressure applied to an unlocking lever (not shown) releases the foot 27 so that the piston can be moved up again under the spring force. As these structures are relatively well known, no further description is believed to be necessary.

Figure 5:
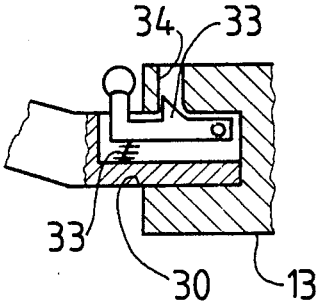
FIG. 5 illustrates a part cross sectional view of a tow bar connected to the truck in accordance with the invention.

Referring to FIGS. 3 and 5, the truck body is provided with a bore 30 in each face 28, 29 of two opposite ends, that is the front end and the rear end for receiving a tow bar 31. As indicated in the FIG. 5, a spring biased cam 32 is disposed on the tow bar 31 for engaging within the bore 30 in order to releasably hold the tow bar 31 therein. As indicated, the cam 32 is pivotally mounted within a recess at the end of the tow bar 31 and is biased upwardly by a spring 33 within the tow bar recess. In addition, an arm 32' projects upwardly from the cam 32 to permit the cam 32 to be depressed against the force of the spring 33 in order to disengage the cam 32 from within a bore 34 within the truck 13.

Referring to FIG. 3, the truck body is provided with four recesses 35 with a groove 36 in the sides. Each recess 35 is sized to receive a pair of jaws 37 of a brake (see FIG. 4). One of the brake jaws 37 includes a key 38 which is able to engage in a groove 36 of a respective recess 35 in order to hold the brake jaws 37 against rotation.

Figure 4:
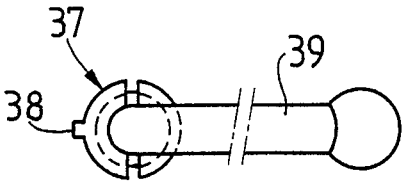
FIG. 4 illustrates a broken view of a support rod and a brake of the truck shown in FIG. 2.

As indicated in FIG. 4, the brake jaws 37 serve to receive a support rod 39 in a pivotal relation. That is, the support bar 39 is mounted as indicated in FIG. 2 so as to be pivotally mounted on the side of the truck body for retaining a fiber bale 9 thereon. The brake jaws 37, in turn, are disposed about the support rod 39 in order to impose a braking force thereon during pivoting of the rod 39.

The support rod 39 together with the brake jaws 37 is removed from the truck, as required. Support rods may be provided with both sides of a truck 13 for transport or, if the trucks are provided at the end of a row 5, 6, 7, 8 (FIG. 1), a support rod may be provided at the outermost truck.

The braking action of the brake jaws 37 enables the support rod 39 to pivot but with a movement braked to such an extent that the support rod 39 is pivotable by a predetermined pressure greater than the dead weight component of the support rod 39 in its inclined position at any time.

If a support rod 39 is provided at the outermost truck of a row 5, 8, then during the opening of the fiber bales 9, the support rod 39 is pivoted downwardly by the opening machine 2, in each case by an amount equivalent to that by which a removal means of the machine was introduced more deeply into the fiber bale surface for the corresponding pass. In this way, the support rod 39 does not interfere with the removal operation but is also in a substantially horizontal position after complete extraction of the bale material. As indicated, the support rods 39 are provided only at the longitudinal sides 40, 41 of the truck 13.

Figure 8:
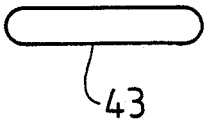
FIG. 8 illustrates a fixing pin for aligning two trucks.
Figure 9:
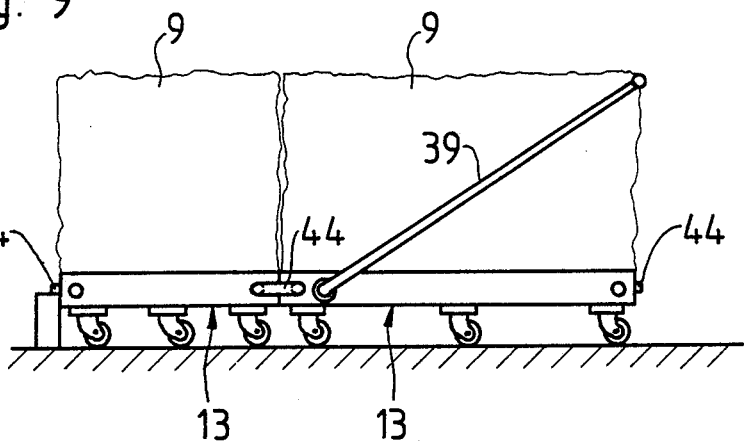
FIG. 9 illustrates a side view of a group of fiber bales mounted on a plurality of trucks in accordance with the invention.
Figure 10:
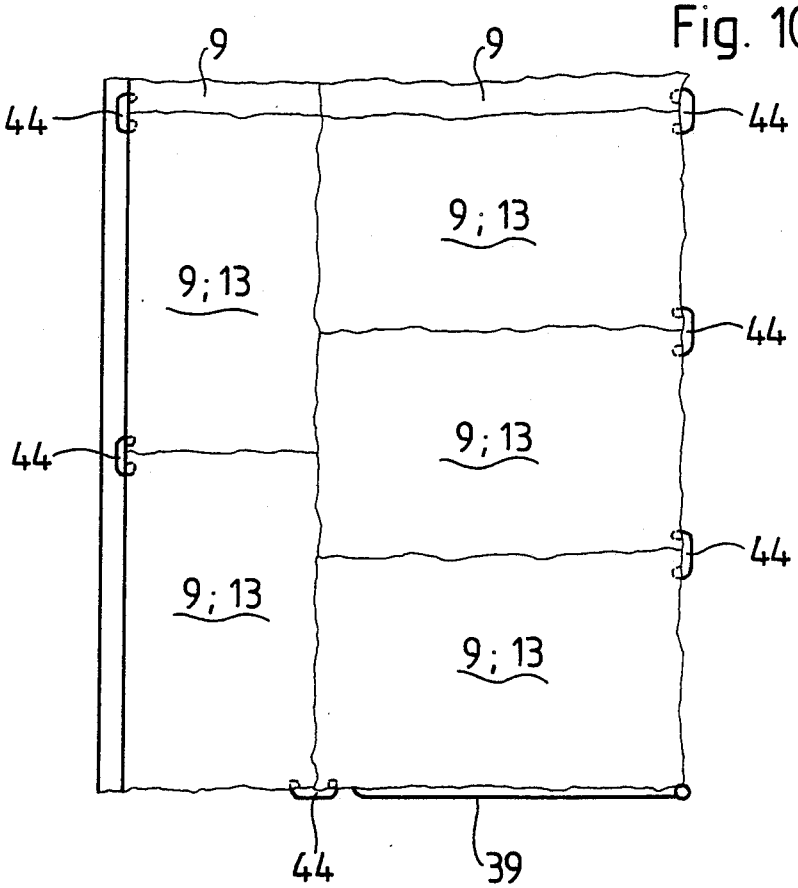
FIG. 10 illustrates a part plan view of the fiber bale group of FIG. 9.

Referring to FIG. 3, the truck body is provided with a recess 42 at each end of each side. These recesses 42 are used to combine individual trucks 13 to form a group. In this case, those sides of a truck which are situated opposite another truck are provided with a fixing pin 43 (see FIG. 8) which is introduced into the respective recesses 42 so that the trucks 13 are aligned with reach other. Also, as indicated in FIGS. 9 and 10, a fixing yoke 44 may be placed in the recesses 42 of adjacent trucks 13 for securement of the trucks together.

Referring to FIGS. 2 and 3, the length L of a truck is adapted to the longest possible length of a fiber bale 9. Likewise, the width M is adapted to the longest possible width of the fiber bale. Thus, the trucks 13 are able to abut one another when forming a group as shown in FIGS. 9 and 10.

Figure 11:
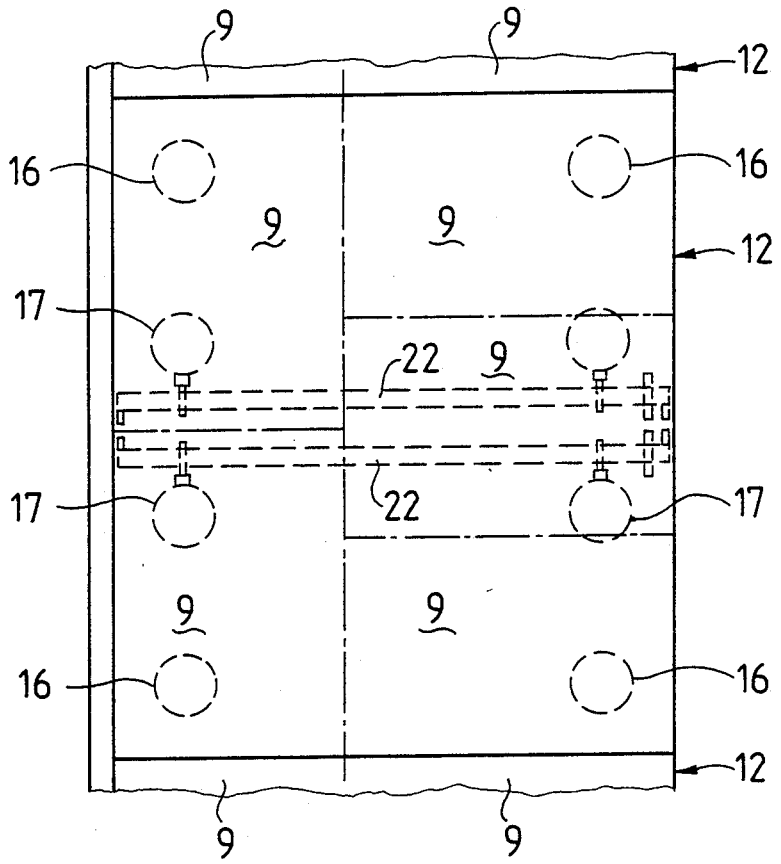
FIG. 11 illustrates a plan view of a modified truck constructed in accordance the invention.

Referring to FIG. 11, wherein like reference characters indicate like parts as above, a truck 12 which is to receive a multiplicity of fiber bales 9, for example five fiber bales is provided with a larger number of castors 16, 17. As indicated, a pair of non-lockable castors 16 is provided at the front and rear ends of the underside of the truck 12 while two pairs of lockable castors 17 are provided in the middle part of the truck to give the truck optimum mobility.

As indicated, the lockable castors 17 are disposed opposite one another in pairs so that the shafts 22 of the locking means therefore are so spaced so that the pedals 24 are directed towards one another. Thus, both pedals 24 can be operated by the pressure of one foot. In this way, all four lockable castors 17 are released by the pressure of one foot until, after displacement of the truck 13, the locking pins 18 are again engaged in the respective locking grooves 19. While the displacement means for moving of the truck is illustrated in the form of castors, other displacement means such as an air cushion, may be used.

The invention thus provides a method of replenishing fiber bales in an operative row adjacent a fiber bale opening machine which can be performed with a minimum of personnel and a minimum of effort.

The invention also provides a truck for transporting a fiber bale which can be readily moved from place to place and locked in place, for example, in a standby position, ready for movement into an operative row of fiber bales for opening purposes. The truck may also be constructed to receive a plurality of fiber bales to form a group for movement into an operative row.

The invention also permits the removal machine travel distance to be no larger than is required for obtaining a necessary mixture.

Further, the invention permits a complete bale group to be pushed manually into an operative position by a week-end staff.

What is claimed is:

1. In a method of replenishing fiber bales to at least one row of fiber bales disposed on a spinning floor in operative positions extending along a path of a reciprocally mounted fiber bale opening machine, said row being formed of groups of fiber bales, the steps of positioning groups of fiber bales in a standby position on said spinning floor and thereafter bringing selected groups of said bales from said standby positions thereof into selected operative positions in said row.

2. A method as set forth in claim 1 wherein fiber bales are individually brought together to form a group of fiber bales at a location remote from said standby position and thereafter moved from said location to said standby position.

3. A method as set forth in claim 2 wherein each bale group includes at least two fiber bales.

* * * * *